US010035036B2

(12) United States Patent
DiMartino

(10) Patent No.: US 10,035,036 B2
(45) Date of Patent: Jul. 31, 2018

(54) WALL-MOUNTED EXERCISE APPARATUS

(71) Applicant: Jeremy DiMartino, Canton, GA (US)

(72) Inventor: Jeremy DiMartino, Canton, GA (US)

( * ) Notice: Subject to any disclaimer, the term of this patent is extended or adjusted under 35 U.S.C. 154(b) by 0 days.

(21) Appl. No.: 15/394,039

(22) Filed: Dec. 29, 2016

(65) Prior Publication Data

US 2017/0182349 A1 Jun. 29, 2017

Related U.S. Application Data

(60) Provisional application No. 62/272,192, filed on Dec. 29, 2015.

(51) Int. Cl.

| | |
|---|---|
| ***A63B 21/04*** | (2006.01) |
| ***A63B 21/00*** | (2006.01) |
| ***A63B 21/055*** | (2006.01) |

(52) U.S. Cl.

CPC ..... *A63B 21/0442* (2013.01); *A63B 21/0557* (2013.01); *A63B 21/154* (2013.01); *A63B 21/4007* (2015.10); *A63B 21/4035* (2015.10)

(58) Field of Classification Search

CPC . A63B 21/04; A63B 21/0442; A63B 21/0552; A63B 21/16; A63B 21/1618; A63B 21/169; A63B 21/1627–21/1681; A63B 21/154–21/156; A63B 21/4001–21/4025; A63B 21/4035; A63B 7/00; A63B 9/00; A63B 2225/10–2225/107

USPC ..... 482/39

See application file for complete search history.

(56) References Cited

U.S. PATENT DOCUMENTS

| | | | | |
|---|---|---|---|---|
| 232,579 | A * | 9/1880 | Weelle | A63B 21/0552 482/129 |
| 4,257,590 | A * | 3/1981 | Sullivan | A63B 21/154 482/133 |
| 4,828,253 | A * | 5/1989 | Schicketanz | A63B 21/154 482/906 |
| 6,280,361 | B1 | 8/2001 | Harvey et al. | |
| 6,413,198 | B1 | 7/2002 | Gray | |
| 8,485,950 | B2 | 7/2013 | Adams | |
| 8,721,507 | B2 | 5/2014 | Blancher | |
| 8,777,822 | B2 | 7/2014 | Agostini | |
| 9,050,493 | B2 | 6/2015 | Perez | |
| 9,629,777 | B2 * | 4/2017 | Shurtleff | A61H 33/063 |
| 2004/0087420 | A1 | 5/2004 | Montesquieux | |
| 2011/0237410 | A1 * | 9/2011 | Perez | A63B 21/0557 482/129 |
| 2011/0319230 | A1 * | 12/2011 | Brendle | A63B 23/03541 482/37 |
| 2012/0083395 | A1 | 4/2012 | Carson | |

(Continued)

*Primary Examiner* — Gregory Winter

(74) *Attorney, Agent, or Firm* — Harness, Dickey & Pierce, P.L.C.

(57) ABSTRACT

A wall-mounted exercise apparatus that includes a plurality of elongate anchor members fixed to a first wall and a second wall, and includes a plurality of hooks fixed to each elongate anchor member. A first strap is configured to be attached to a first hook of the plurality of hooks, and the first hook is located on a first elongate anchor member fixed to the first wall. A second strap is configured to be attached to a second hook of the plurality of hooks, and the second hook is located on a second elongate anchor member fixed to the second wall, wherein the first and second hooks are selected based on a desired difficulty of a selected exercise to be performed.

13 Claims, 4 Drawing Sheets

(56) References Cited

U.S. PATENT DOCUMENTS

| | | | | |
|---|---|---|---|---|
| 2012/0094815 | A1 | 4/2012 | Trettin et al. | |
| 2012/0302412 | A1 | 11/2012 | Nail | |
| 2013/0130866 | A1* | 5/2013 | Wehrell | A63B 21/1403 482/5 |
| 2013/0212857 | A1 | 8/2013 | Donofrio | |
| 2014/0113773 | A1 | 4/2014 | Marghella | |
| 2015/0238799 | A1* | 8/2015 | Arline | A63B 21/0442 482/129 |
| 2015/0367158 | A1* | 12/2015 | Pretz | A63B 21/0442 482/129 |
| 2017/0056702 | A1* | 3/2017 | Carter | A63B 21/0442 |

* cited by examiner

WALL-MOUNTED EXERCISE APPARATUS

CROSS-REFERENCE TO RELATED APPLICATIONS

This application claims the benefit of U.S. Provisional Application No. 62/272,192, filed on Dec. 29, 2015. The entire disclosure of the above application is incorporated herein by reference.

FIELD

The present disclosure relates to a wall-mounted exercise apparatus.

BACKGROUND

This section provides background information related to the present disclosure which is not necessarily prior art.

Many exercise apparatuses are known. The functionality of these exercise apparatuses, however, is limited.

SUMMARY

This section provides a general summary of the disclosure, and is not a comprehensive disclosure of its full scope or all of its features.

The present disclosure provides a wall-mounted exercise apparatus, including a plurality of elongate anchor members fixed to a first wall and a second wall; a plurality of hooks fixed to each elongate anchor member; a first strap configured to be attached to a first hook of the plurality of hooks, the first hook being located on a first elongate anchor member fixed to the first wall; and a second strap configured to be attached to a second hook of the plurality of hooks, the second hook being located on a second elongate anchor member fixed to the second wall; wherein the first and second hooks are selected based on a desired difficulty of a selected exercise to be performed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
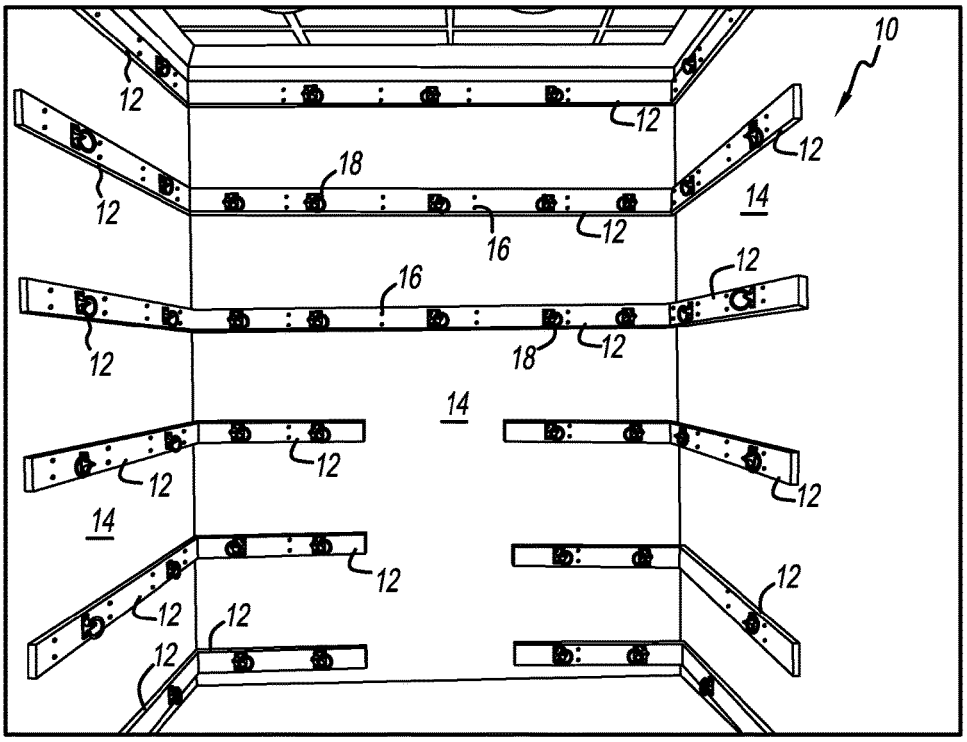
FIG. 1 is a perspective view of an exemplary wall-mounted exercise apparatus according to a principle of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

FIG. 1 illustrates a wall-mounted exercise apparatus 10 according to a principle of the present disclosure. Wall-mounted exercise apparatus 10 includes a plurality of elongate anchor members 12 that are fixedly anchored to walls 14 of a structure such as a building. Although elongate anchor members 12 are illustrated as being fixed to three walls 14, it should be understood that any number of walls 14 is contemplated including a single wall 14, two walls 14, the three walls 14 illustrated, or four walls 14 without departing from the scope of the present disclosure. Preferably, walls 14 are arranged ninety degrees relative to each other, but the present disclosure should not be limited thereto. In this regard, walls 14 can be arranged relative to each other at angles greater (e.g., 135 degrees) or less (e.g., 45 degrees) than ninety degrees without departing from the scope of the present disclosure.

Elongate anchor members 12 in the illustrated embodiment are formed from wood (e.g., wooden 2×4's), but may be formed from any rigid material known to one skilled in the art including, for example, rigid resin materials, metal materials such as steel or aluminum, or polymeric materials. Regardless, elongate anchor members 12 are preferably fixedly anchored to walls 14 by a plurality of fasteners such as screws 16. As illustrated in FIG. 1, the elongate anchor members 12 are arranged in parallel at different heights along walls 14, which allows for various resistances to be provided during use of the wall-mounted exercise apparatus, as will be described in more detail below. In this regard, adjacent elongate anchor members 12 may be separated in a height direction by a distance that ranges between six inches to twenty-four inches, or separated by distances greater than twenty-four inches. Lengths of the elongate anchor members 12 are variable.

Elongate anchor members 12 each include a plurality of hooks 18. As will be described in more detail below during description of the operation of wall-mounted exercise apparatus 10, hooks 18 allow for attaching various resistance bands 20 and pulleys 22 (see FIG. 2) to elongate anchor members 12 at a plurality of different positions on each wall 14 to allow for practicing a plurality of different exercises. Hooks 18 are fixed to elongate anchor members 12. Any number of hooks 18 can be fixed to each elongate anchor member 12. Further, although hooks 18 are illustrated as being aligned in a vertical direction on each elongate anchor member 12, it should be understood that the present disclosure should not be limited to such a configuration. That is, hooks 18 can be arranged in a staggered manner, if desired. Preferably, hooks 18 are formed from a rigid material such as steel or some other type of metal material.

Figure 2:
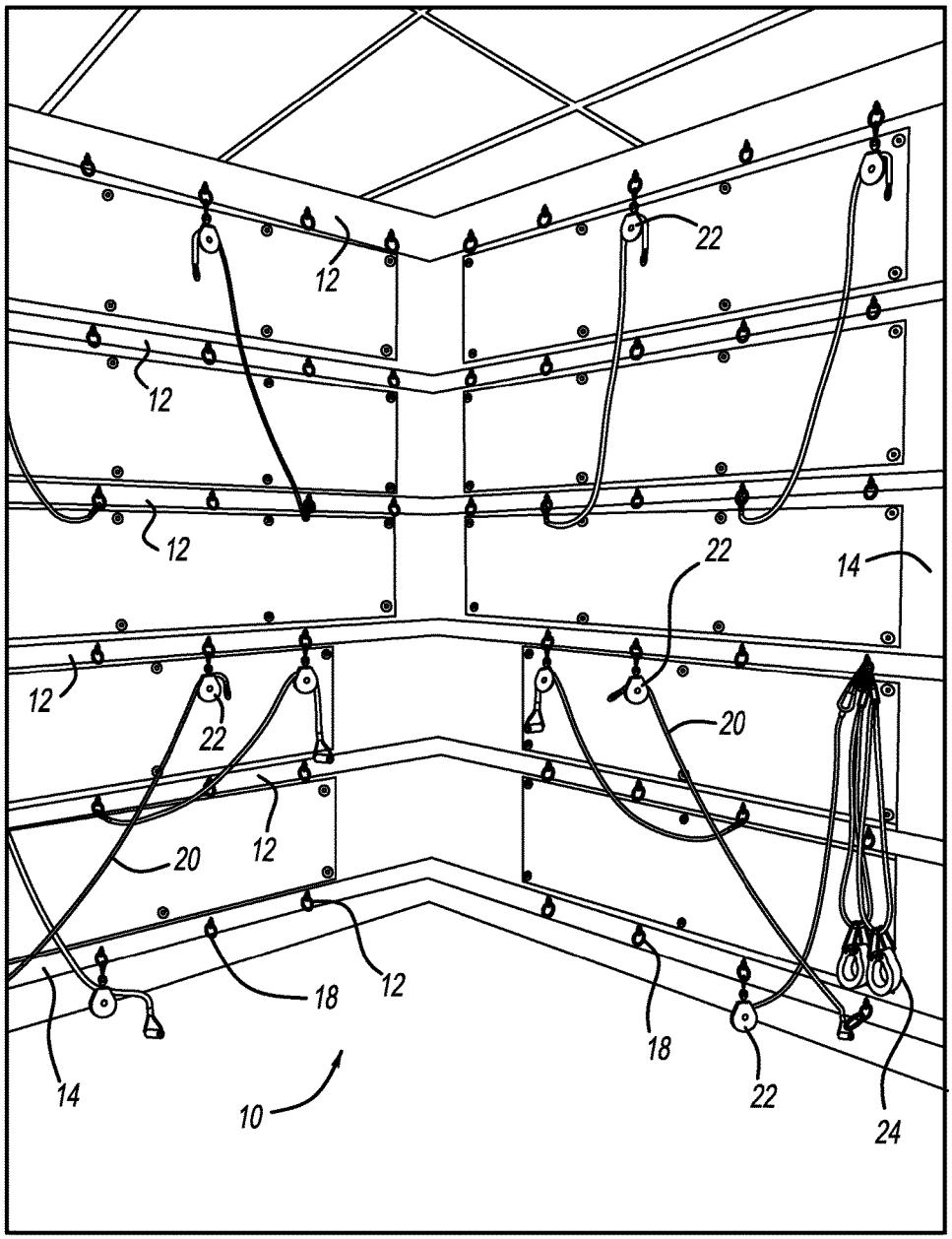
FIG. 2 is a perspective view of another exemplary wall-mounted exercise apparatus according to a principle of the present disclosure.

Now referring to FIG. 2, it can be seen that a plurality of straps or resistance bands 20 and pulleys 22 are removably attached to hooks 18. Resistance bands 20 may be formed from a polymeric or rubber material, and have different resistances. Alternatively, each resistance band 20 can have the same resistance and multiple bands 20 can be used to increase the resistance thereof during use. Because wall-mounted exercise apparatus 10 includes a plurality of elongate anchor members 12 arranged at different heights on walls 14, and because each elongate anchor member 12 has a plurality of hooks 18, the resistance bands 20 may be attached to different locations relative to the user that can either increase or decrease the difficulty of performing various exercises using wall-mounted exercise apparatus 10.

For example, it can be seen in FIG. 2 that resistance bands 20*a* are attached to hooks 18*a* of elongate anchor members 12*a*. Further, resistance bands 20*a* are coupled to a pulley 22*a* attached to a hook 18*b* of elongate anchor members 12*b*. If user was to pull on handles 24 attached to resistance bands 20*a* and perform, for example, a rowing exercise, the difficulty of performing the rowing exercise would be harder than an instance where the resistance band 20*a* is attached to pulley 22*b* attached at hook 18*c* of elongate anchor member 12*c* because hook 18*c* and elongate anchor member 12*c* are located at a lesser height in comparison to elongate anchor member 12*b*. This is because the user will have to stretch the resistance band 20 a lesser distance. That is, if the resistance bands 20 are attached to hooks 18 and pulleys 22 that are located closer to the user, the difficulty of performing the selected exercise is decreased. In contrast, if the resistance bands 20 are attached to hooks 18 and pulleys that are located further away from the user, the difficulty of performing the selected exercise is increased. In this manner, the exercise difficulty can be tailored for each individual user based on experience level, or the amount of rehabilitation or strenuous activity that is desired for the individual user.

Figure 3:
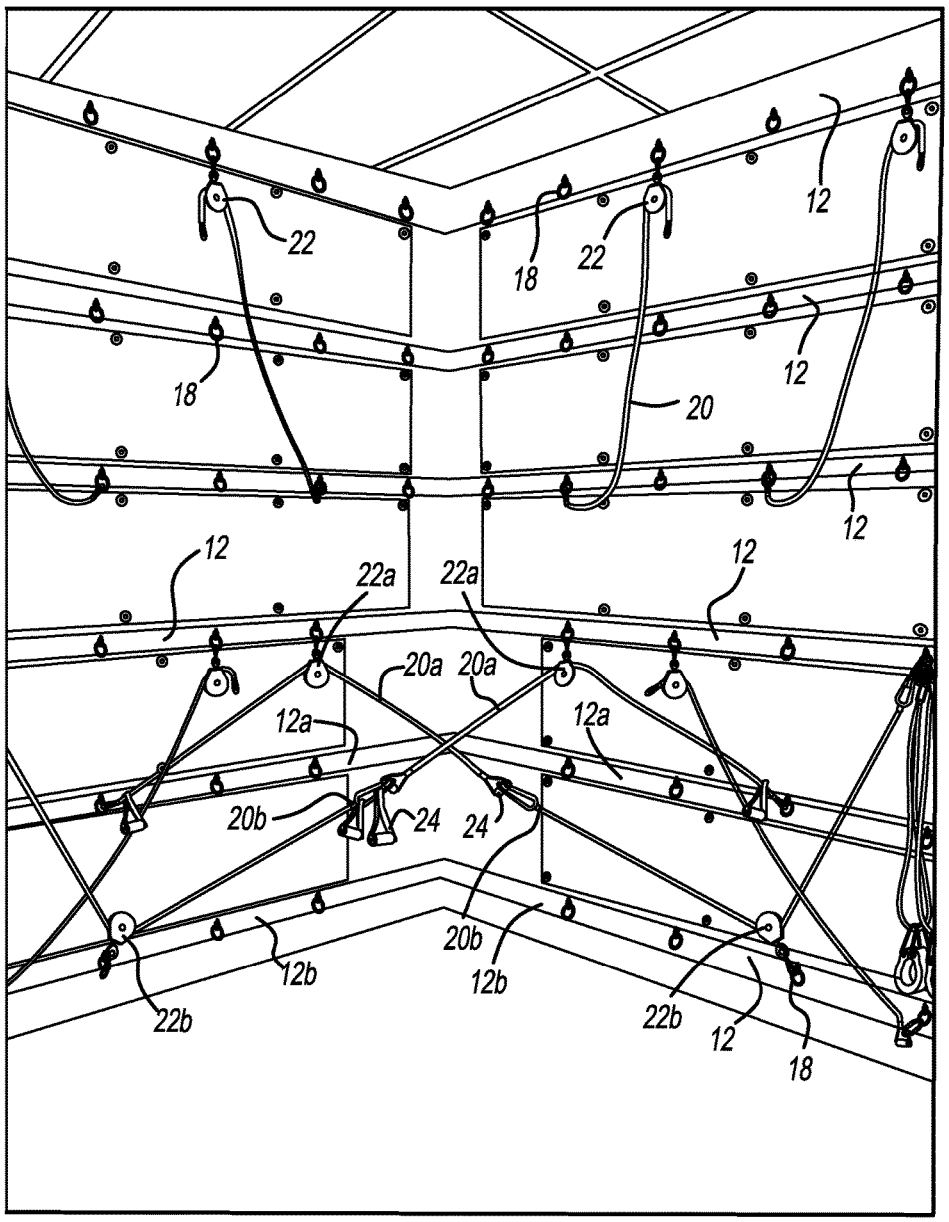
FIG. 3 is a perspective view of an exemplary wall-mounted exercise apparatus according to a principle of the present disclosure.

It should be understood that multiple bands 20 may also be used simultaneously to increase the difficulty of the selected exercise, or to cause multiple muscle groups to be exercised simultaneously. For example, as best shown in FIG. 3, it can be seen that bands 20*a* and 20*b* are used simultaneously with handle 24 placed therebetween. Further, it can be seen that bands 20*a* and 20*b* are each use different elongate anchor members 12*a* and 12*b* and pulleys 22*a* and 22*b*. By using bands 20*a* and 20*b* attached to elongate anchor members 12*a* and 12*b* and pulleys 22*a* and 22*b* that are located at different heights, the user is forced to use multiple muscle groups during an exercise such as, for example, a rowing exercise. The multiple muscle groups are required to use proper form when completing the selected exercise. Further, the use of multiple bands 20*a* and 20*b* increases the resistance experienced by the user.

Figure 4:
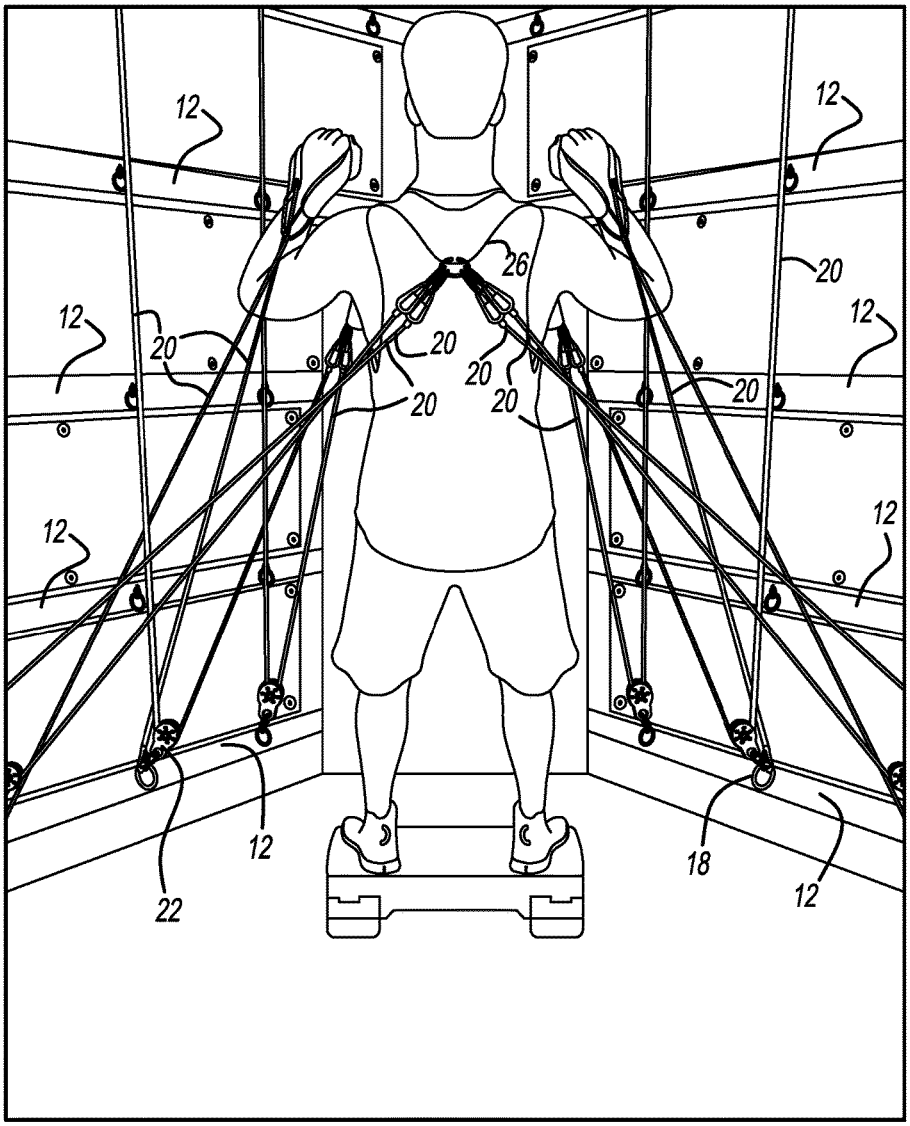
FIG. 4 is perspective view of user utilizing an exemplary wall-mounted exercise apparatus according to a principle of the present disclosure.

Although the use of a rowing exercise has been described above, it should be understood that a plurality of different exercises may be conducted using the wall-mounted exercise apparatus 10. For example, in addition to rowing exercises, the wall-mounted exercise apparatus 10 may be used for conducting military press exercises, squats, bicep curls, tricep extension, bench press exercises, and the like, without limitation. As shown in FIG. 4, a user is using a plurality of bands 20 attached are different anchoring points simultaneously to conduct either a squat exercise or a military press exercise. In addition, it should be noted that the user is wearing a vest 26 to which additional bands 20 may be attached. Accordingly, the increase in resistance can further be increased.

It should be understood that although the above disclosure describes wall-mounted exercise apparatus as using resistance bands 20, the present disclosure should not be limited thereto. In this regard, it should be understood that ropes, cables, or chains may be attached to hooks 18 in lieu of resistance bands 20 so that the only resistance provided during use of wall-mounted exercise apparatus 10 is the user's bodyweight.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A wall-mounted exercise apparatus, comprising:

a plurality of elongate anchor members, the plurality of elongate anchor members including at least a first elongate anchor member, a second elongate anchor member, a third elongate anchor member, a fourth elongate member, a fifth elongate anchor member, and a sixth elongate anchor member, the first elongate anchor member being configured to be fixed to a first wall and the second elongate member configured to be attached to a second wall;

a plurality of hooks fixed to each of the plurality of elongate anchor members;

a first strap configured to be attached to a first hook of the plurality of hooks, the first hook being located on the first elongate anchor member fixed to the first wall;

a second strap configured to be attached to a second hook of the plurality of hooks, the second hook being located on the second elongate anchor member fixed to the second wall;

a first pulley coupled to the third elongate anchor member, the third elongate anchor member configured to be fixed to the first wall;

a second pulley connected to the fourth elongate anchor member, the fourth elongate anchor member configured to be fixed to the second wall;

the fifth elongate anchor member configured to be fixed to the first wall, and the sixth elongate anchor member configured to be fixed to the second wall; and a third strap attached to the fifth elongate anchor member, and fourth strap attached to the sixth elongate anchor member, wherein the first and second hooks are selected based on a desired difficulty of a selected exercise to be performed;

the third and fourth elongate anchor members are configured to be positioned at different heights on the first and second walls, respectively, in comparison to the first and second elongate anchor members; and the third and fourth straps are used in conjunction with the first and second straps based on the desired difficulty of the exercise to be performed.

2. The wall-mounted exercise apparatus according to claim 1, wherein the first strap is coupled to the first pulley, and the second strap is coupled to the second pulley.

3. The wall-mounted exercise apparatus according to claim 1, wherein the first elongate anchor member is arranged in parallel with the third elongate anchor member, and the second elongate anchor member is arranged in parallel with the fourth elongate anchor member.

4. The wall-mounted exercise apparatus according to claim 1, wherein the straps are comprised of a resistance band.

5. The wall-mounted exercise apparatus of claim 1, wherein each of the elongate anchor members are arranged in parallel on each of the first and second walls.

6. The wall-mounted exercise apparatus of claim 5, wherein a length of each of the elongate anchor members is arranged orthogonal to a height direction of the first and second walls.

7. The wall-mounted exercise apparatus of claim 1, wherein the first and second walls are arranged ninety degrees relative to each other.

8. The wall-mounted exercise apparatus of claim 1, wherein the first and second walls are opposed to each other.

9. The wall-mounted exercise apparatus of claim 1, wherein the first wall includes a plurality of the elongate anchor members, and the second wall includes a plurality of the elongate anchor members.

10. The wall-mounted exercise apparatus of claim 9, wherein the elongate anchor members of the first wall are separated by a distance that ranges between six inches and twenty-four inches, and the elongate anchor members of the second wall are separated by a distance that ranges between six inches and twenty-four inches.

11. The wall-mounted exercise apparatus of claim 9, further comprising a plurality of elongate anchor members configured to be fixed to a third wall.

12. The wall-mounted exercise apparatus of claim 11, wherein the third wall is positioned between the first wall and the second wall.

13. The wall-mounted exercise apparatus of claim 12, wherein the third wall is arranged orthogonal to each of the first and second walls.

* * * * *